United States Patent [19]

Spademan

[11] Patent Number: 4,471,505

[45] Date of Patent: Sep. 18, 1984

[54] TOOTHBRUSH AND BRISTLE

[76] Inventor: Richard G. Spademan, 130 Country Club Dr. #30, Incline Village, Nev. 89450

[21] Appl. No.: 293,749

[22] Filed: Aug. 17, 1981

Related U.S. Application Data

[63] Continuation-in-part of Ser. No. 79,931, Sep. 28, 1979, abandoned.

[51] Int. Cl.[3] ..... A46B 9/04

[52] U.S. Cl. ..... 15/167 R; 15/186

[58] Field of Search ..... 15/159 A, 167 R, 167 A, 15/186, 187, 188, 236 R, 110, 111, 244 R; 433/142, 143; 128/62 A

[56] References Cited

U.S. PATENT DOCUMENTS

| | | | |
|---|---|---|---|
| 589,209 | 8/1897 | Gould | 15/188 |
| 1,002,468 | 9/1911 | Strangman | 15/188 X |
| 1,691,863 | 11/1928 | Van Sant | 15/188 |
| 2,146,455 | 2/1939 | Tepper | 15/188 |
| 2,364,205 | 12/1944 | Fuller | 15/188 UX |
| 2,637,870 | 5/1953 | Cohen | 15/188 |
| 4,167,794 | 9/1979 | Pomeroy | 15/167 R |

FOREIGN PATENT DOCUMENTS

| | | | |
|---|---|---|---|
| 322089 | 6/1920 | Fed. Rep. of Germany | 15/167 R |
| 482434 | 9/1929 | Fed. Rep. of Germany | 15/167 R |

*Primary Examiner*—Peter Feldman

*Attorney, Agent, or Firm*—Townsend and Townsend

[57] ABSTRACT

A toothbrush (1) comprising a plurality of T-shaped bristles (5) is described. Each of the bristles (5) comprises an elongated cleansing head (11,22) terminated at each end by rounded ends (13,27) and having between the ends a plurality of cleansing elements (12,24). The rounded ends (13,27) are provided for presenting a nonabrasive surface to the subgingival surfaces (17) surrounding a tooth when the cleansing surface of the cleansing head (11,22) is moved across the surface of the tooth during cleansing of the tooth. In one embodiment, the cleansing elements (12,24) are conically shaped members (12) terminated by a relatively sharp tip. In another embodiment of the invention the cleansing elements (12,24) comprise parallel, substantially rectangular members (24) terminated by a relatively sharp edge (25). While flexible, the tip or edge (25) of the cleansing elements (12,24) of the head (11,22) generally remains in contact with the surface of the tooth while the head (11,22) is moved across the surface of the tooth.

30 Claims, 23 Drawing Figures

FIG. 1
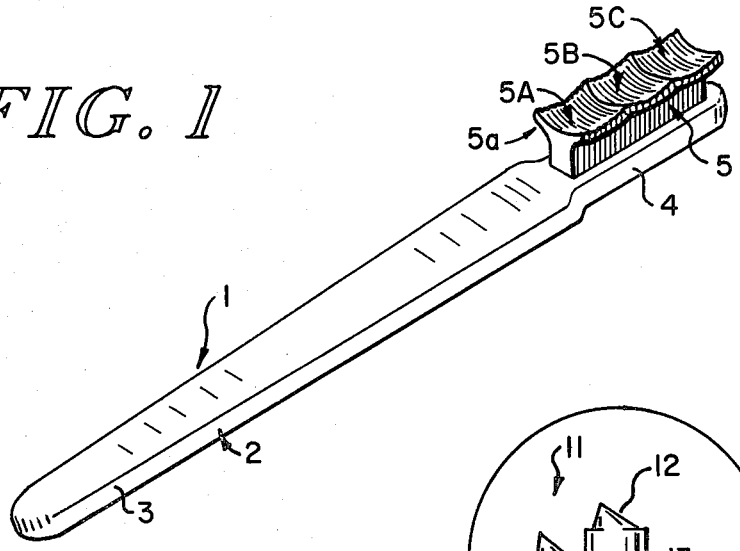
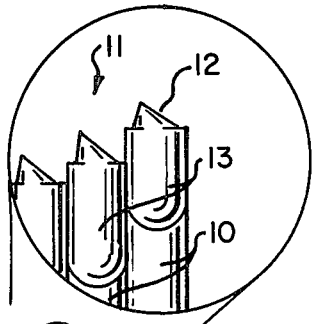
FIG. 3
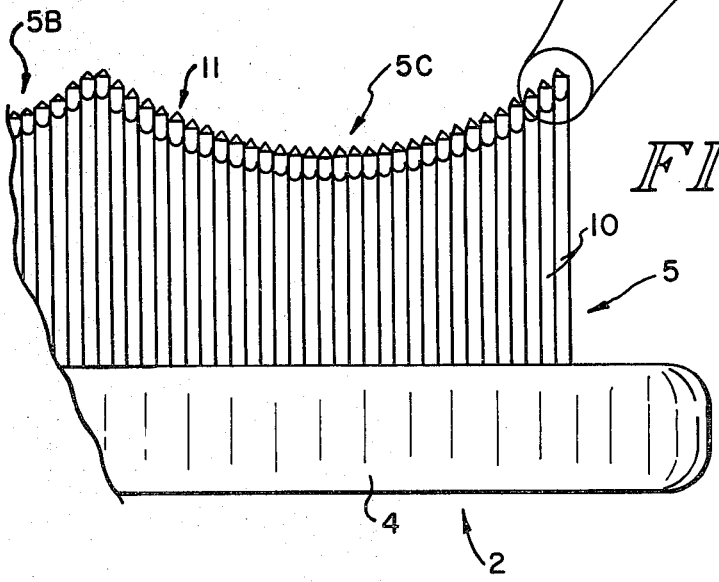
FIG. 2

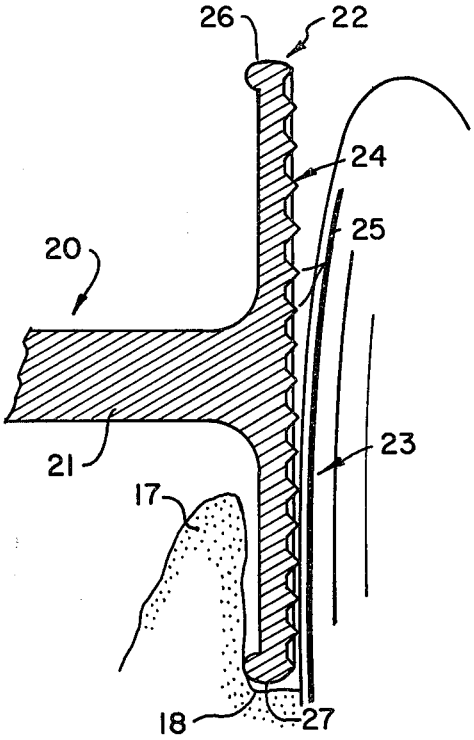
FIG. 10
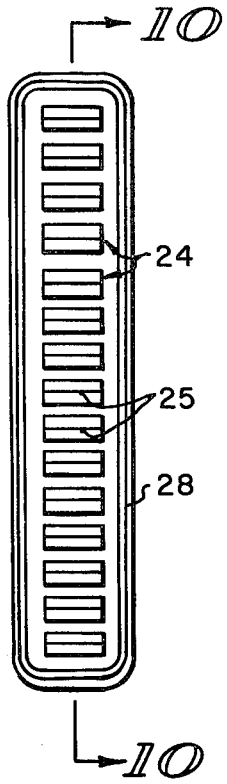
FIG. 8
FIG. 9
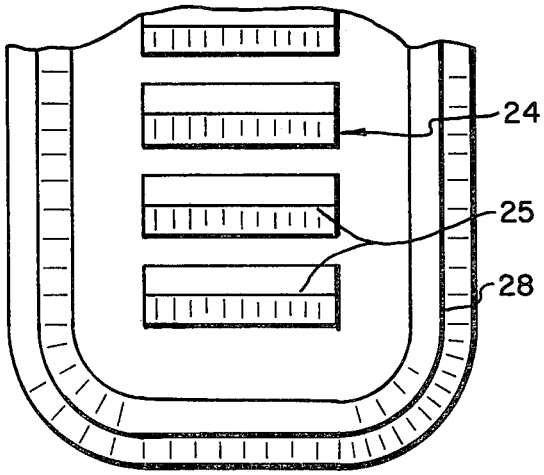

FIG. 14.
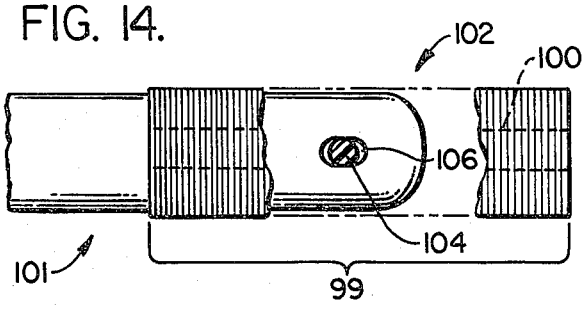
FIG. 17.
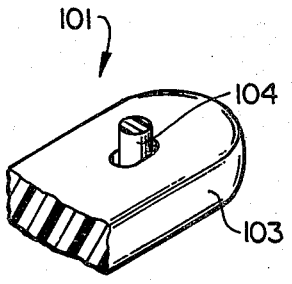
FIG. 15.
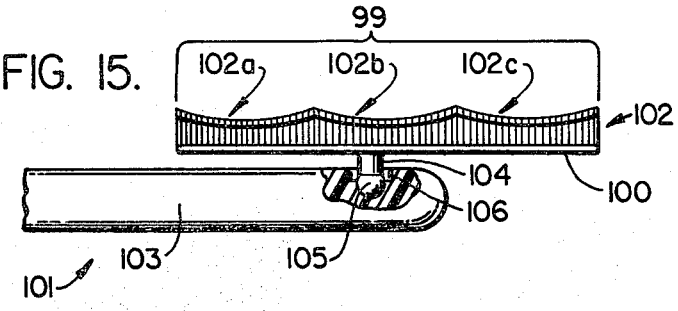
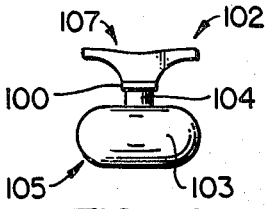
FIG. 16.
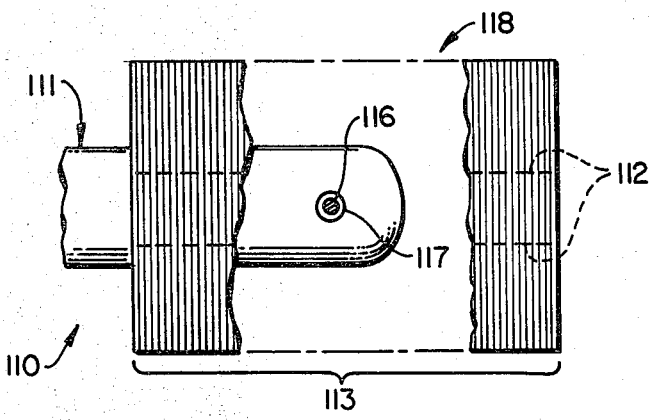
FIG. 18.
FIG. 19.
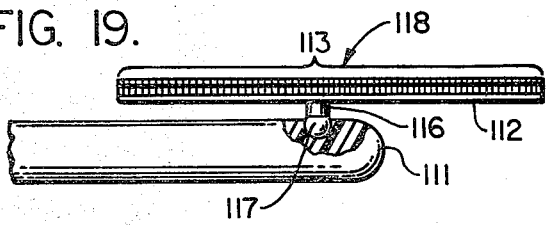
FIG. 20.
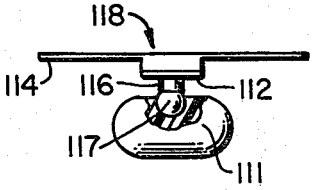

TOOTHBRUSH AND BRISTLE

RELATED APPLICATION

The present application is a continuation-in-part of applicant's application Ser. No. 079,931 filed Sept. 28, 1979 entitled, "Toothbrush and Bristle", now abandoned.

BACKGROUND OF THE INVENTION

The present invention relates to toothbrushes in general and more specifically to a toothbrush bristle configuration providing improved and effective removal of microbial plaque accumulation from the exposed and subgingival surfaces of teeth.

Plaque control retards the formation of calculus and is critical in the prevention of periodontal disease.

In the past, the most dependable mode of controlling plaque has been mechanical cleansing with a toothbrush and other cleansing aids. However, conventional toothbrushes have not been entirely effective in removing the microbial plaque from beneath the gingival margin in the sulcus and the high plaque retaining areas in the interproximal embrasures of adjacent teeth. This is due to several reasons. First, a straight tip of a conventional brush bristle does not tend to enter the gingival sulci when the brush is held in a plane generally perpendicular to the long axis of the tooth. Secondly, the sharp point of the bristle tends to damage the gingiva and mucosa if the brush is held at an acute angle to the long axis of the tooth in an attempt to enter the sulci. Thirdly, the flex of the bristles tends to prevent the most effective bristle tip posture for cleansing when the brush is activated.

Studies show that the most aggressive mechanical cleansing should be directed toward the tooth surface, much less so toward the gingival surface and none toward the base of the gingival sulcus. The basis for these observations is as follows.

The development of gingival inflammation and dental cavities is most frequently caused by failure to remove dental plaque from the subgingival surface of the tooth and to a much lesser extent materia alba from the gingival surface in the subgingival space. Both dental plaque and materia alba can form within several hours and therefore frequent mechanical cleansing is essential. Materia alba which consists primarily of an acquired bacterial coating and desquamated epithelial cells, leucocytes and a mixture of salivary proteins and lipids is a soft sticky deposit less adherent than dental plaque. It can be flushed away with a water spray but more completely removed from the gingiva with mild mechanical cleansing.

Dental plaque is formed by oral microorganisms which synthesize harmful products which are destructive to the tooth and gum when not removed from the gingival sulcus. The toxins formed by the microorganisms cause cellular damage to the gingiva with subsequent inflammation (gingivitis) and eventually destruction of the supporting structures (periodontitis). When gingivitis occurs, vascular dilatation, capillary proliferation, engorged vessels and sluggish venous return causes a stretched and thinned epithelium that is sensitive to mechanical trauma such as aggressive brushing.

Dental plaque with associated gingivitis also causes exposure of the root surface (recession) with increased occurrence of cavities (dental caries). Exposure of the root surface can also occur due to faulty brushing by repeated direct trauma to the base of the sulcus (gingival abrasion). When a pathologically deepened gingival sulcus (periodontal pocket) occurs, the pathological condition may become exacerbated because plaque can more readily occur. If dental plaque is not removed calculus is formed by mineralization of the bacterial plaque. Calculus can form within several hours of plaque formation. Calculus has a bacterial plaque coating and exacerbates gingivitis and gingival recession by both chemical irritation from the formed toxins and destruction from the mechanical irritation of the calculus mass. Subgingival calculus usually extends near but does not reach the base of periodontal pockets in chronic periodontal lesions. Calculus holds the plaque against the gingiva.

Since materia alba can be removed by light mechanical cleansing and gingival inflammation causes thinning of the gingival epithelium the mechanical cleansing requirement of the gingival surface is much less than the requirement for removing dental plaque from the surface of the teeth. Accordingly, a toothbrush which fulfills these requirements while protecting the base of the gingival sulcus is desirable.

The surfaces of teeth in a set of teeth are typically non-uniform and curved with the curved surfaces varying in magnitude and direction from tooth to tooth. Heretofor, the bristle support of a conventional toothbrush has been typically rigidly mounted to the end of the toothbrush handle. Typically the length and width of a conventional bristle support exceeds the distance between two adjacent teeth so that frequently the surfaces of the teeth in the interproximal embrasures are not contacted by the bristles of the bristle support, particularly if the bristles are relatively stiff.

Another disadvantage of prior known toothbrushes is that the cleansing of the subgingival surfaces of the teeth is difficult to do by the "up and down" mechanical motion typically accompanying a conventional toothbrushing technique. This is because the sulcus is relatively shallow and it is difficult for one brushing one's teeth to judge how deeply to penetrate the sulcus without causing injury to the base of the sulcus. Consequently, there is a tendency to avoid penetrating the sulcus.

Because the teeth and gingiva have poor sensory perception, the user of a toothbrush must rely on the brush design to assure proper position and pressure of the cleansing elements against the teeth surfaces. The maximum cleansing element contact is assured by designing maximum flexibility into the brush parts while retaining the brush's capability to provide sufficient pressure of the cleansing tips against the teeth to remove the plaque and not damage the enamel and gingiva.

Toothbrush bristles of various configurations are disclosed in patents to Pomeroy, U.S. Pat. No. 4,167,794, Hills, U.S. Pat. No. 3,722,020, Brant, U.S. Pat. No. 3,295,156, Axelsson, U.S. Pat. No. 3,939,520, and Cooney, U.S. Pat. No. 2,088,839. Toothbrushes having moveable bristle supports of various configurations are disclosed in patents to Rashbaum, U.S. Pat. No. 3,398,421, Akizawa, U.S. Pat. No. 1,932,878, and Doolittle, U.S. Pat. No. 1,260,258.

SUMMARY OF THE INVENTION

In view of the foregoing, a principal object of the present invention is an improved toothbrush in general and an improved bristle cleansing head in particular which has a shape and surface configuration for removing dental plaque from the exposed and subgingival surfaces of a tooth including the interproximal embrasure surfaces while minimizing damage to the gingival tissues facing the tooth and in the base of the sulcus.

Another object of the present invention is a toothbrush bristle as described above comprising a cleansing head, wherein the opposite ends of the cleansing head are rounded for presenting a nonabrasive surface to the gingival tissue surfaces surrounding a tooth when the cleansing surface of the cleansing head is moved across the surface of the tooth during cleansing of the tooth.

Still another object of the present invention is a toothbrush bristle as described above comprising a cleansing head with a cleansing surface, wherein the cleansing surface of the cleansing head comprises a plurality of cleansing elements located between the opposite ends of the cleansing head.

Still another object of the present invention is a toothbrush bristle as described above comprising a cleansing head with a plurality of cleansing elements, wherein each of the cleansing elements is provided with a sharp edge or tip for scraping the surface of the tooth during cleansing of the tooth.

Still another object of the present invention is a toothbrush bristle as described above comprising a cleansing head with a smooth surface opposed to the cleansing surface, wherein the smooth surface of the cleansing head protects against injury to the subgingival surfaces surrounding the tooth to be cleansed.

Still another object of the present invention is a toothbrush as described above having a plurality of bristles in which each of the bristles comprises a stem and, located on one end of said stem, an elongated cleansing head having a cleansing surface comprising a plurality of cleansing elements which extend perpendicularly in opposite directions from the stem.

In a preferred embodiment of the present invention, the toothbrush comprises a plurality of special bristles each having a T-shape which, when mounted to the handle of a toothbrush, are located side by side forming substantially three sets of bristles of varying stem length. The varying length of the stems in each set generally conforms the set of bristles to the contour of the surface of a tooth for improving cleansing in the interproximal embrasure of adjacent teeth. Of course, various stem lengths, cleansing head sizes, and different shapes of sets of bristles may be employed in a particular application.

In an alternative embodiment of the present invention, the toothbrush comprises a handle having a handheld portion and a smaller brush-supporting portion on which a generally rectangular-shaped cleansing head is directly mounted. A portion of the cleansing head extends laterally from the handle and includes a plurality of cleansing elements. The cleansing elements each comprise an elongated rectangular member terminated by a sharp edge. The opposite ends of the cleansing head are rounded to present a nonabrasive surface to the gingival surfaces. Singular or multiple cleansing heads, which are removable and replaceable on the handle, may be used and may be of various sizes, shapes and flexibility.

The present invention further provides an improved toothbrush having the above described bristles, a handle and a bristle support with means for movably mounting the bristle support to the handle. The bristle mass can be narrow relative to the length of the long axis of a tooth and the means for movably mounting the bristle support to the handle comprises means for allowing the bristle support to move about an axis perpendicular to the longitudinal axis of the handle during normal use of the toothbrush. To prevent the cleansing surface of the bristle cleansing heads from leaving the surface of the tooth during normal use, the mounting means also includes means for preventing movement of the bristle support about an axis parallel to the longitudinal axis of the handle.

In another embodiment of the invention there is provided a bristle mass which has a width and length which is large relative to the size of a tooth. In this embodiment there is provided a means for movably mounting the bristle support to a handle comprising means for allowing the bristle support to move about axes both perpendicular and parallel to the longitudinal axis of the handle during normal use of the toothbrush. This dual action is permissible because the length and width of the bristle mass is sufficient to prevent the cleansing surface of the bristle cleansing heads from leaving the surface of the tooth while at the same time the cleansing heads are free to move and follow the contours of the tooth as well as into and out of the interproximal embrasures of adjacent teeth and gingival sulci.

In still another embodiment of the present invention, there is provided an improved toothbrush with a handle and a bristle support as described above wherein the means for movably mounting the bristle support to the handle comprises means for moving the bristle support in an oscillatory fashion along a line perpendicular to the longitudinal axis of the handle.

In the latter embodiment the means for moving the bristle support in an oscillatory fashion perpendicular to the longitudinal axis of the handle may comprise a conventional vibrating reed mechanism, a mechanical assembly using eccentric wheels or cams, or the like.

Prior known brushes utilizing movable bristle supports do not exhibit the advantages for cleaning the subgingival surfaces and the surfaces in the interproximal embrasures disclosed in the present invention. A movable bristle support is particularly effective when used in combination with the mechanism of the present invention.

In an alternative embodiment of the present invention, the bristle stem bases are laterally spring loaded in the bristle support to accomodate to the contour of the sulci bases. The bristle stems are spring loaded to move laterally to accomodate the sulci bases and vertically to accomodate to the gross contours of the teeth. The cleansing elements are also spring loaded to accomodate to the finer contours of the teeth. A torsion resistant flexible bow assures that the peripheral blunt cleansing tips are held in the proper orientation against the teeth.

BRIEF DESCRIPTION OF THE DRAWINGS

The above and other objects, features and advantages of the present invention will become apparent from the following detailed description of the accompanying drawings in which:

FIG. 1 is a side view of a toothbrush according to the present invention.

FIG. 2 is an enlarged side view of a portion of the bristles and handle of FIG. 1.

FIG. 3 is an enlarged side view of the tips of a part of the bristles of FIG. 2.

FIG. 8 is a plan view of a cleansing head of a bristle according to an alternative embodiment of the present invention.

FIG. 9 is an enlarged plan view of a portion of the cleansing head of FIG. 8.

FIG. 10 is an end view of a portion of the bristle of FIG. 8.

FIG. 14 is a partial plan view of the bristle support of a toothbrush according to the present invention.

FIG. 15 is a side elevation view of FIG. 14.

FIG. 16 is an end view of FIG. 15.

FIG. 17 is a partial perspective view of the handle and post of the embodiment of FIGS. 14–16 with the bristle support omitted for clarity.

FIG. 18 is a partial plan view of the bristle support of another embodiment of a toothbrush according to the present invention.

FIG. 19 is a side elevation view of FIG. 18.

FIG. 20 is an end view of FIG. 19.

DETAILED DESCRIPTION OF THE DRAWING

Figure 4:
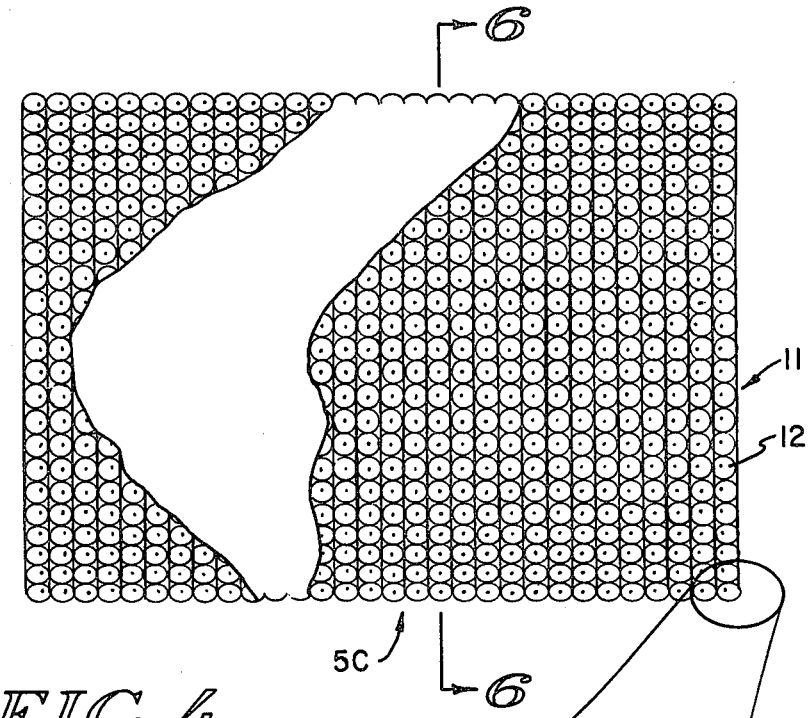
FIG. 4 is a plan view of FIG. 2.
Figure 5:
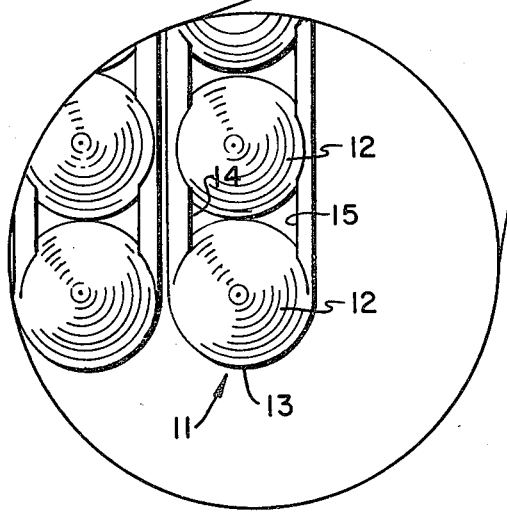
FIG. 5 is an enlarged plan view of the tips of two of the bristles of FIG. 4.

Referring to FIGS. 1–7, there is provided in accordance with the present invention a toothbrush designated generally as 1. In the toothbrush 1 there is provided a handle 2 having a hand-held portion 3 and a bristle support 4 on which is mounted a plurality of bristles 5. As shown in FIG. 1, the bristles 5 essentially comprise three sets of bristles of varying lengths designated 5*a*, 5*b* and 5*c*, respectively.

Referring to FIG. 2, the bristles 5 in each one of the sets of bristles 5*a*, 5*b* and 5*c* are provided with a stem 10. An elongated cleansing head 11 comprising a plurality of cleansing elements 12 located between the opposite ends of the cleansing head 11, extends perpendicularly in opposite directions from said stem 10 for forming a T-shaped bristle. The length of the head 11 is sufficient for providing at least a portion thereof lateral of the handle 2 as seen in FIG. 1 at 5*a*.

Each of the plurality of cleansing elements 12 of a cleansing head 11 comprises a conically shaped member terminated by a relatively sharp tip for scraping the surface of a tooth during cleansing of the tooth. The opposite ends of the cleansing head 11 are rounded, as shown at 13 in FIGS. 3, 5 and 6, for presenting a nonabrasive surface to the gingival surfaces, as shown at 17 in FIG. 6, surrounding a tooth when the cleansing elements 12 of the cleansing head 11 are moved across the surface of a tooth during cleansing of the tooth.

Extending laterally along each of the cleansing elements 12, there is provided a wall 14 and 15, which has an upper edge somewhat lower than the height of the tip portion of the cleansing elements 12. The walls 14 and 15, together with the elements 12, form pockets for receiving and containing cleansing compound such as conventional toothpaste.

Each of the cleansing elements 12 has a diameter of approximately 0.010 inches. Between the ends 13 of the cleansing head 11 there are provided approximately 36 of the cleansing elements 12. With 36 of the cleansing elements 12 located between the ends 13 of each of the cleansing heads 11, each of the cleansing heads 11 has a length of approximately 0.36 inches. The dimension, 0.010 inches, for each of the cleansing elements 12 was chosen because it is somewhat larger than the minimum dimension which can be reliably held using current molding techniques. In fabricating the toothbrush, approximately 100 of the bristles 5 are mounted in a line on the bristle support 4 of the handle 2. With 100 bristles 5 mounted on the handle 2, the brush mass is approximately one inch in length. Having a length of one inch and a width of about 0.36 inches, the brush is approximately the same size as a conventional toothbrush.

Figure 6:
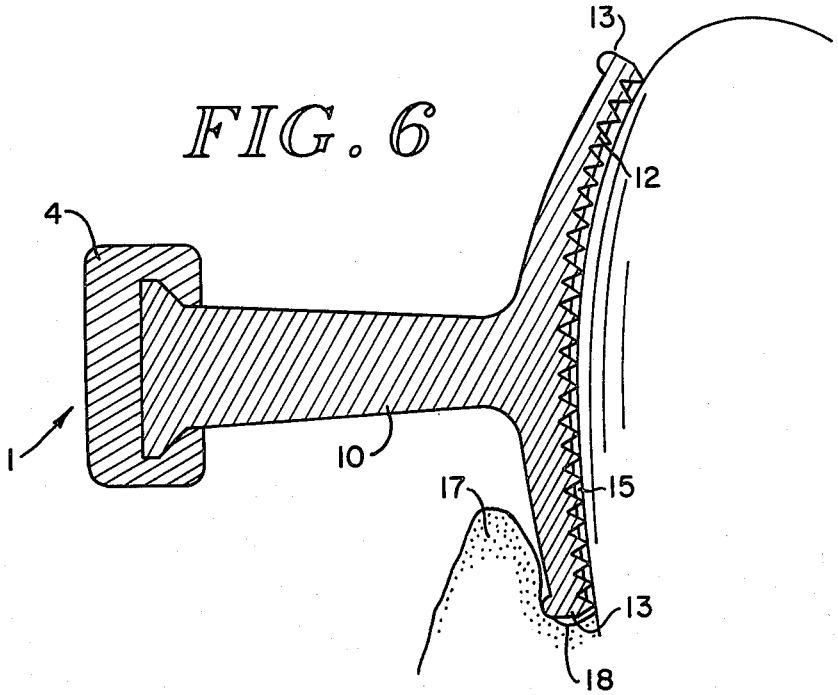
FIG. 6 is an end view of the bristles and handle of FIG. 4.

In use, the cleansing elements 12 of the bristles 5 scour the tooth surface while the ends 13 penetrate below the gingival surface into the gingival sulcus 18 so as to remove foreign matter from the tooth and gingival surfaces 17, as shown in FIG. 6. In cleaning the tooth and gingival surfaces 17, gum and tooth life are promoted.

Figure 7:
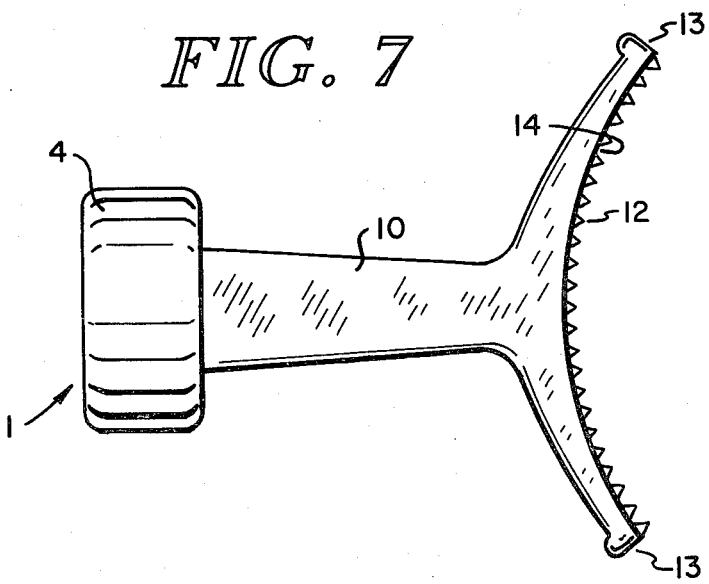
FIG. 7 is an end view of the toothbrush and bristles of FIG. 6, shown in a flexed condition.

Referring to FIG. 7, to insure intimate contact between the surface of a tooth and the cleansing element 12 at all times, the head 11 may be formed to be flexibly concave to conform to the contour of a typical tooth.

Referring to FIGS. 8–10, there is shown in an alternative embodiment of the present invention a T-shaped bristle 20 comprising a stem 21 and a cleansing head 22. Between the opposite ends of the cleansing head 22 there is provided, for forming a cleansing surface 23, a plurality of cleansing elements 24. Each of the elements 24 comprises an elongated rectangular member terminated by a sharp edge 25. The opposite ends 26 and 27 of the head 22 are rounded for presenting a nonabrasive surface to the gingival surfaces 17 surrounding the tooth when the cleansing surface 23 and specifically the cleansing elements 24 are moved across the surface of the tooth during cleansing of the tooth.

Around the periphery of the cleansing head 22, there is provided a wall 28. The height of the wall 28 is somewhat lower than the height of the cleansing elements 24 so as not to interfere or otherwise impair the cleansing action of the cleansing members 24. The wall 28, together with the space between the cleansing elements 24, form pockets for receiving cleansing compound such as conventional toothpaste.

In use, as described above, the shape of the cleansing heads 11 and 22 allows the cleansing head to readily enter the gingival sulci when the brush is held in the most common positions used in brushing the teeth. In addition, the shape of the tips of the elements 12 and 24 minimize gingival damage. Also the mechanical cleansing action of the cleansing elements 12 and 24 is more effective than the conventional straight tip bristle when the bristles are in a flexed condition. The point of a straight-tip bristle is effective only when the brush is held in a narrowly defined relationship to the sulci and under minimal flex.

Figure 11:
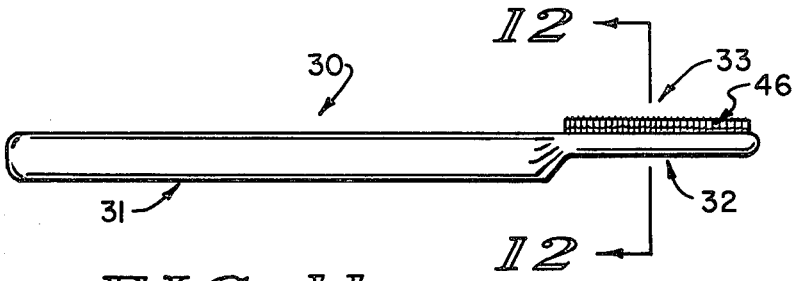
FIG. 11 a side view of an alternative embodiment of the present invention.
Figure 12:
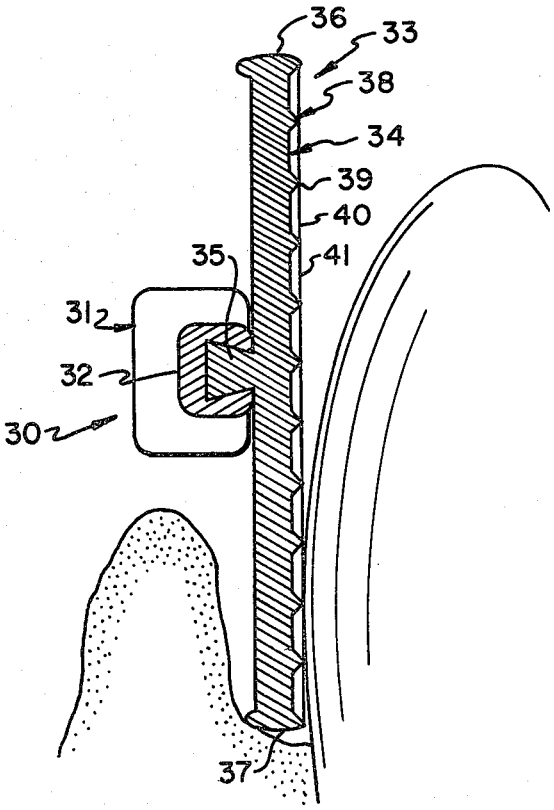
FIG. 12 is a cross-sectional view taken through lines 12—12 of FIG. 11.
Figure 13:
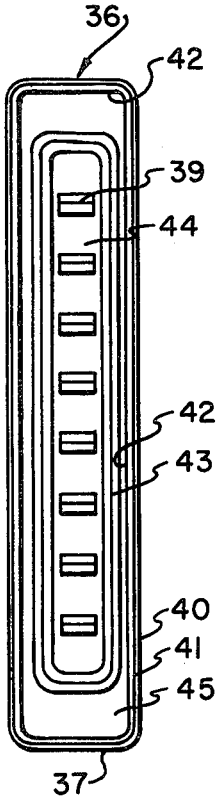
FIG. 13 is a plan view of the cleansing head of the bristle of FIG. 12.

Referring to FIGS. 11–13, there is provided in an alternative embodiment of the present invention a toothbrush 30 comprising a handle 31 and a bristle support 32 and a cleansing head 33 having a cleansing surface 34. Extending from the center of the cleansing head 33, there is provided a dovetailed shaped tongue member 35 for fitting in a correspondingly shaped groove provided therefor in the bristle support 32. The tongue member 35 and the groove provided therefor allow for removal and replacement of the cleansing head 33. Other tongue and groove shapes as well as suitable adhesive may be used in the absence of tongue and grooves for mounting the cleansing head 33 to the bristle support 32.

On the cleansing surface 34, between the rounded end portions 36 and 37, there is provided a plurality of rectangularly shaped cleansing elements 38. Each of the elements 38 is terminated by a sharp edge 39. Extending about the periphery of the cleansing head 33, partially enclosing the cleansing elements 38, there is provided a rectangularly shaped wall 40. The wall 40 is terminated by a sharp edge 41. Interior of the wall 40, surrounding the cleansing elements 38, there is provided a second rectangularly shaped wall 42. The wall 42 is also terminated by a sharp edge 43. The interior surfaces of the wall 43 and the cleansing elements 38 form recesses or pockets 44 for receiving and containing cleansing compound, such as conventional toothpaste. Similarly, the interior surfaces of the wall 40 and the exterior surfaces of the wall 42 form recesses or pockets 45 for also containing cleansing compound such as conventional toothpaste.

As in the previous embodiments described above, a plurality of the cleansing heads 33 are mounted on the bristle support 32 of the toothbrush 30 for forming a brush 46 having substantially the same overall length and width as conventional toothbrushes.

Referring to FIGS. 14–17, there is provided in accordance with an additional embodiment of the present invention, a toothbrush designated generally as 101. In the toothbrush 101 there is provided a bristle support designated generally as 100 mounted on a handle 103. The bristle support 100, containing a multiplicity of bristles 102, has a bristle mass 99 length corresponding to approximately the width of two to three adult teeth and the width corresponding to half the length of a typical adult tooth. It is also provided with three sets of bristles of different bristle lengths designated generally as 102*a*, 102*b* and 102*c*. The bristle 102 and the curved shape of the bristle groups 102*a*, 102*b* and 102*c* correspond to the bristle 5 and curved shape of the bristle groups 5*a*, 5*b* and 5*c* shown in FIGS. 1–5.

The bristle support 100 is mounted to the handle 103 of the toothbrush 101 by means of a post 104. The post 104 is movably mounted to the handle 103 by means of a ball member 105 inserted in a spherically shaped cavity in the base of a rectangularly shaped cavity 106. The length of the cavity 106 is sufficient to permit a predetermined angular movement of the bristle support 100 while the width of the cavity 106 is only slightly larger than the width of the post 104 so as to prevent movement of the post 104 and, consequently, movement of the bristle support 100 about an axis parallel to the longitudinal axis of the handle 103. Alternatively, the base of the post 104 may be movably mounted to the handle 103 by means of a pin or the like for rotation about an axis perpendicular to the longitudinal axis of the handle 103.

In use, as the toothbrush 101 is moved over the teeth, the bristle support 100 is free to pivot about an axis perpendicular to the longitudinal axis of the handle 103. As the head moves relative to this perpendicular axis, the cleansing surfaces of the cleansing heads 107 follow the contour of the teeth. As the bristle support 100 follows the contour of the teeth the cleansing heads 107 are better able to enter and clean the interproximal embrasures of adjacent teeth and gingival sulci than heretofore possible using conventional toothbrushes without a movable bristle support 100 containing the unique bristles 102 of the present invention.

Referring to FIGS. 18–20, there is provided in another embodiment of the present invention, a toothbrush designated generally as 110. In the toothbrush 110 there is provided a handle designated generally as 111 on which is mounted a bristle support 112 carrying a plurality of bristles designated generally as 118. Extending laterally from the bristle support 112, there are provided overhanging bristle cleansing heads 114. The preferred width of the cleansing heads 114 is related to the average depth of an adult gingival sulcus comprising healthy tissue which is approximately two millimeters in depth and the maximum depth encountered when periodontal disease exists, which is approximately twelve millimeters in depth. The actual width of the overhanging cleansing heads 114 in a particular toothbrush may, of course, vary depending upon the application and the condition of the teeth with which it is intended to be used for the reasons described above.

The length of the bristle mass 113 typically corresponds to the length of the bristle mass 99 described above with respect to the embodiment of FIGS. 14–17. The width, however, may be somewhat larger such that during normal brushing there is no tendency for the cleansing surfaces of the cleansing heads 114 to lift from the teeth as the brush is moved over the surface of the teeth.

To mount the bristle support 112 to the handle 111 there is provided a post 116. The base of the post 116 is provided with a spherical member 117 which is fitted into a corresponding spherical cavity for permitting movement of the bristle support 112 about an axis perpendicular to and about an axis parallel to the longitudinal axis of the handle 111 during normal use of the toothbrush. Because of the relatively large width of the bristle mass 113, there is, as described above, no tendency for the cleansing surface of the cleansing heads 114 to lift from the teeth during normal use of the brush. Consequently, the bristle support 112 will follow the surface of the teeth in two directions of travel of the toothbrush as the brush is moved over the surface of the teeth.

In use, movement of the toothbrush 110 is accompanied by a gentle insertion of the overhanging cleansing heads 114 into the sulcus of a tooth for cleansing the subgingival surfaces of the tooth as more fully described above.

Figure 21:
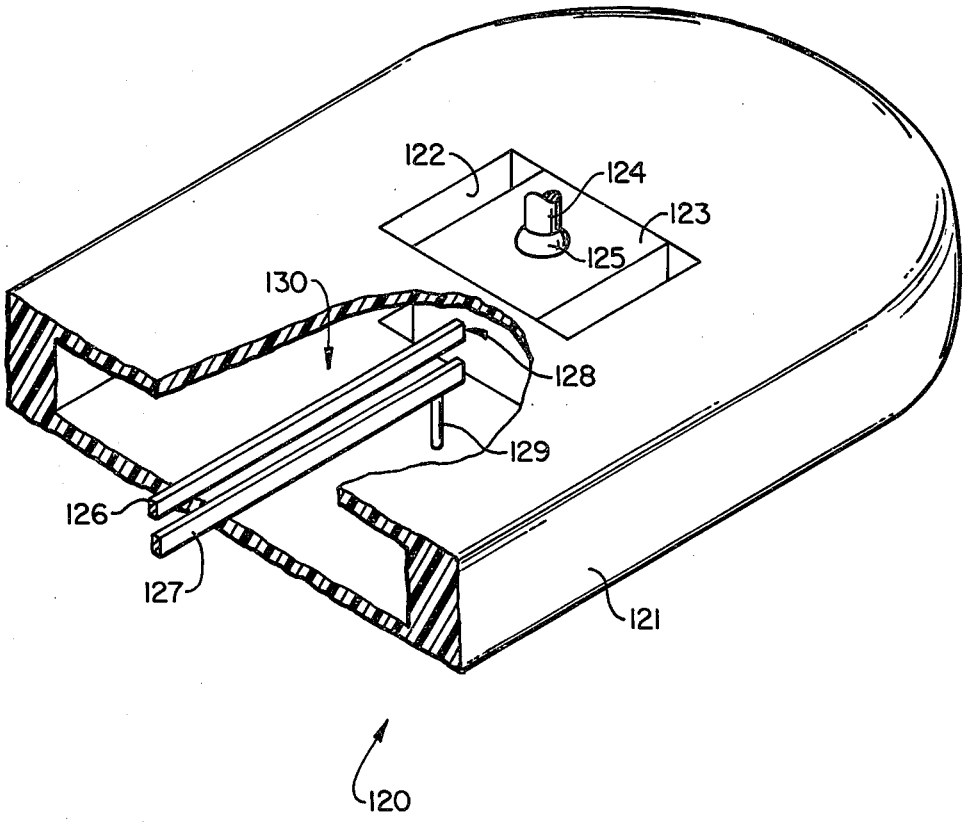
FIG. 21 is a partial perspective view of still another embodiment of a toothbrush according to the present invention showing a portion of the mechanism for oscillating the bristle support in a direction perpendicular to the longitudinal extent of the toothbrush handle.

Referring to FIG. 21, there is provided in still another embodiment of the present invention a partial view of a toothbrush designated generally as 120. In the toothbrush 120 there is provided a handle designated generally as 121. In the handle 121 there is provided a rectangular cavity 122. Slidably inserted in the cavity 122 for movement perpendicular to the longitudinal axis of the handle 121, there is provided a block-shaped member 123. Movably mounted to the block-shaped member 123 there is provided a post 124. The post 124 is mounted to the block 123 by means of a spherical member 125 which is mounted in a spherically-shaped cavity provided therefor in the block 123. Mounted in a cavity 130 provided therefor in the handle 121, there is provided a pair of electrically conductive reed members 126 and 127. One end of the reed member 126 is attached to the block 123 at a point designated as 128. The corresponding end of the reed member 127 is supported in the cavity by means of a post 129.

Mounted to the end of the post 124 extending from the block 123 there is provided a bristle support, not shown, corresponding to either the bristle support 100 of the embodiment of FIGS. 14–16 or the bristle support 112 described above with respect to the embodiments of FIGS. 18–20.

If the bristle mass and support 100 described above with respect to the embodiment of FIGS. 14–16 is mounted to the post 124, the spherically-shaped mounting member 125 is replaced by a member and cavity corresponding to the member 105 and cavity 106 of the embodiment of FIGS. 14–17 so as to restrict movement of the bristle support about an axis parallel to the axis of the handle of the toothbrush 121. Alternatively, a transverse pin is used to mount the post 124 to the block 123.

Generally, however, the embodiment of FIG. 21 will be used with a bristle mass and support corresponding to the bristle mass 113 and support 112 of the embodiment of FIGS. 18–20.

With a bristle support corresponding to the bristle support 112 of the embodiment of FIGS. 18–20, the movable block member 123 is adapted to move within the cavity 122 approximately two to three millimeters.

In operation, electrical signals are applied to the reed members 126 and 127 in a conventional manner such that the reed member 126 moves in an oscillatory fashion relative to the fixed reed member 127. As the reed member 126 moves in an oscillatory fashion relative to the reed member 127, the block member 123 attached to the end of the reed member 126 is caused to move a corresponding distance. With the bristle mass and support corresponding to the bristle mass 113 and support 112 described above with respect to FIGS. 18–20 attached to post 124, this oscillatory motion results in the overhanging bristle cleansing heads 114 to enter the sulcus and cleanse the subgingival surfaces of the teeth.

The amplitude and frequency of the motion of the block 123 and a bristle support attached thereto may be changed to satisfy the requirements of a particular application by changing the frequency and amplitude of the electrical signals applied to the reed members 126 and 127 as well as by changing the mass of the bristle support and block member 123 to which it is attached.

Figure 22:
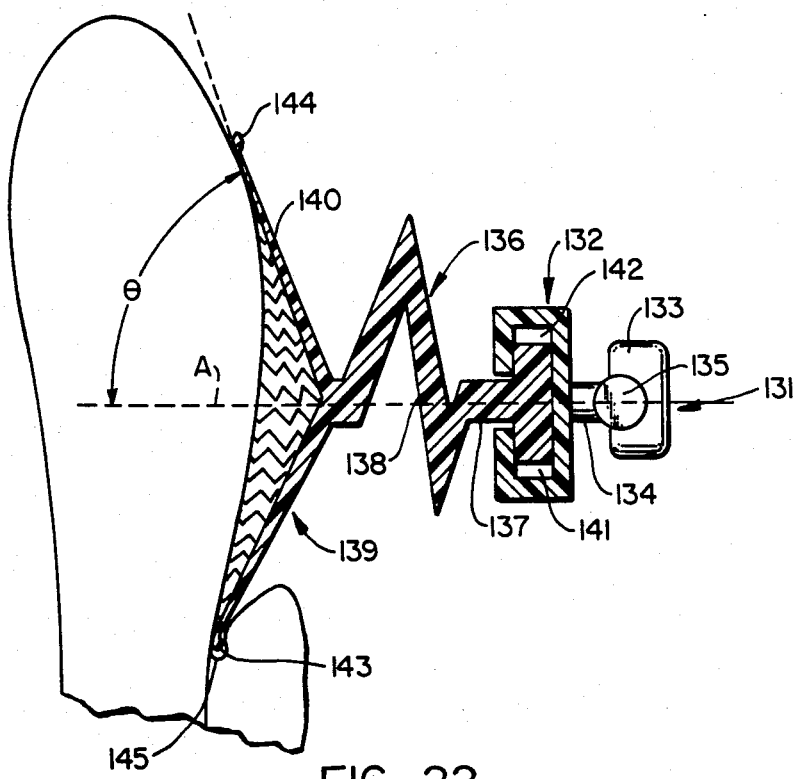
FIG. 22 is a cross-sectional view of a bristle of an alternative embodiment of the present invention and is taken on line 22—22 of FIG. 23.
Figure 23:
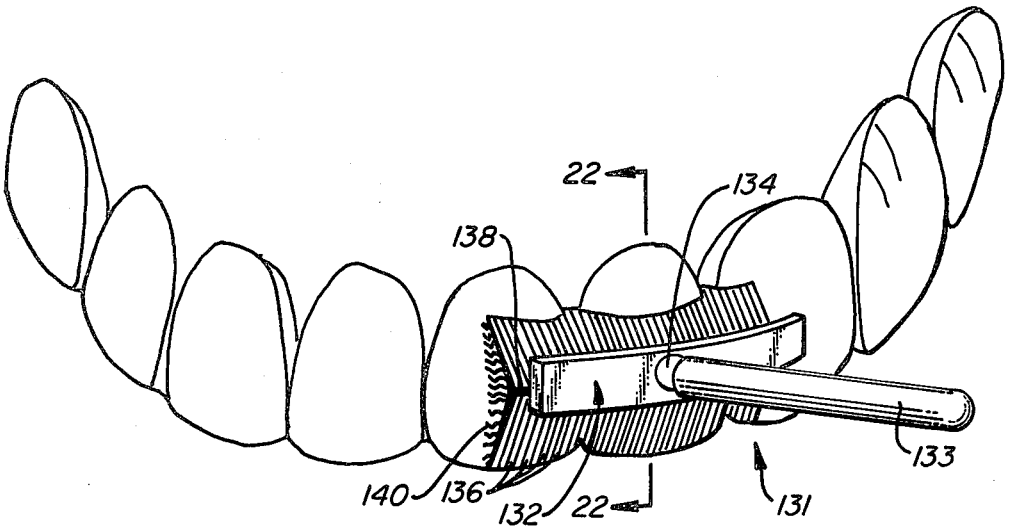
FIG. 23 is a perspective view of a toothbrush with bristles as shown in FIG. 22.

Referring to FIGS. 22 and 23, there is provided in an additional embodiment to the present invention a toothbrush designated generally as 131. In the toothbrush 131 there is provided a bristle support designated generally as 132 mounted on a handle 133. To mount the bristle support 132 to the handle 133 there is provided a post 134. The base of the post 134 is provided with a spherical member 135 which is fitted into a corresponding spherical cavity for permitting movement of the bristle support 132 about an axis perpendicular to and about an axis parallel to the longitudinal axis of the handle 133 during normal use of the toothbrush.

A typical toothbrush 131 will contain a plurality of bristles designated generally as 136. Each bristle 136 has at its bottom end an inverted T-shaped base 137, is followed in its mid-range with a Z-shaped stem 138 and terminates at its top with a Y-shaped cleansing head 139. The side holding and cleansing means 140 forms an acute angle Θ with the axis A of the stem 138. Within the cleansing head 139 are located a plurality of flexibly folded cleansing elements 140 which accomodate to the finer contours of the teeth. Each T-shaped base 137 is inserted into a correspondingly shaped cavity in the bristle support 132 and held in place by springs 141 and 142. Springs 141, 142 allow the bristle 136 to move laterally to accomodate to the sulcus 145 and allow ease of bristle replacement. The flexible Z-shaped stem 138 readily moves laterally to accomodate to the sulcus 145 and vertically to accomodate to the gross contours of the teeth. The torsion resistant flexible Y-shaped cleansing head 139 assures that the peripheral blunt cleansing tips 143, 144 are held in the proper orientation against the teeth.

While a plurality of embodiments of the present invention are described, together with suggested alternative features, it is contemplated that still other changes and modifications may be made to the embodiments described without departing from the spirit and scope of the present invention. For example, instead of having a brush comprising a plurality of bristles of varying stem length, it is possible to have a brush in which the length of the stem of the bristles is uniform throughout the brush. Similarly, the size of the bristle and the length and slope of the stem and cleansing head may be changed for any particular application. Also, the cleansing head need not necessarily be T-shaped, but may be round or some other shape. So long as at least a portion of the cleansing surface extends laterally from the handle, the cleansing head can penetrate into the subgingival sulcus region. In lieu of using electrically operated reed members to accomplish bristle support oscillation, various other types of electro-mechanical devices may be used such as, for example, those using eccentric wheels and cams. For these reasons, it is intended that the scope of the present invention not be determined by reference to the embodiments described, but rather be determined by reference to the claims hereinafter provided and their equivalents.

What is claimed is:

1. A toothbrush bristle for cleansing subgingival surfaces comprising an elongated cleansing head having a rounded end, a first side surface adjacent to said end, a second side surface adjacent to said end and opposed to said first side surface, the second side surface having abrasive cleansing means distributed over at least a part of the length thereof, the spacing between said sides being sufficiently small to enable the cleansing portion of the head adjacent the end to penetrate the gingival sulcus of the user and thereby cleanse subgingival tooth surfaces.

2. A toothbrush bristle according to claim 1 wherein the cleansing head sides diminish in spacing toward the rounded end of the cleansing head.

3. A toothbrush bristle according to claim 1 wherein the cleansing means comprises at least one cleansing element terminating in a relatively sharp cleansing element end to facilitate the cleansing of the tooth surface.

4. A toothbrush bristle according to claim 1 wherein the cleansing means comprises means for holding a cleansing compound in the vicinity of the cleansing means.

5. A toothbrush bristle according to claim 4 wherein the holding means comprises at least one recess located adjacent to the cleansing means.

6. A toothbrush bristle according to claim 5 wherein the first side surface is smooth to protect against injury to subgingival surfaces surrounding the tooth to be cleansed.

7. A toothbrush bristle for cleansing subgingival surfaces comprising an elongated stem, an elongated cleansing head having an end, a first side surface adjacent to said end, and a second side surface adjacent to said end and opposed to said first side surface, the second side surface having cleansing elements terminating in a multiplicity of relatively sharp cleansing element ends to facilitate the cleansing of the tooth surface distributed over at least a part of the length thereof, the spacing between said sides being sufficiently small to enable the cleansing portion of the head adjacent the end to penetrate the gingival sulcus of the user and thereby cleanse subgingival tooth surfaces.

8. A toothbrush bristle according to claim 6 wherein the second side surface forms an acute angle with respect to the axis in the elongate direction of the stem.

9. A toothbrush bristle according to claim 8 wherein the stem is centrally located with respect to the cleansing head and wherein the second side surface extends in opposite directions therefrom.

10. A toothbrush bristle according to claim 7 wherein the cleansing head has sufficient flexibility to enable it to generally conform to the contour of the tooth surface over which the cleansing head is moved during the cleansing of the tooth surface.

11. A toothbrush bristle according to claim 10 wherein the cleansing head is longitudinally curved.

12. A toothbrush for cleansing subgingival surfaces comprising a handle having a bristle support, a multiplicity of bristles having elongated stems, each bristle comprising an elongated cleansing head having a rounded end, a first side surface adjacent to said end, a second side surface adjacent to said end and opposed to said first side surface, the second side surface having abrasive cleansing elements distributed over at least a part of the length thereof, the spacing between said sides being sufficiently small to enable the cleansing portion of the head adjacent the end to penetrate the gingival sulcus of the user and thereby cleanse subgingival tooth surfaces.

13. A toothbrush according to claim 12 wherein the second side surfaces form acute angles with respect to the axis in the elongate direction of the stems and wherein the magnitude of the acute angle of the second side surfaces relative to its associated stem is a function of the position of the bristle among the multiplicity of bristles.

14. A toothbrush according to claim 13 wherein the stems are centrally located with respect to the second side surfaces.

15. A toothbrush according to claim 14 wherein the stem of each bristle has a length which varies as a function of the position of the bristle among the multiplicity of bristles.

16. A toothbrush according to claim 13 wherein the multiplicity of bristles is divided into a plurality of bristle sets each set comprising several bristles, and wherein the magnitude of the acute angle of the second side surface and the length of the stem of each of the several bristles in a set is a function of the position of the bristle in its set.

17. A toothbrush according to claim 16 wherein the magnitude of the acute angle of the second side surface and the length of the stem of each of the bristles in a set decreases uniformly from the ends of the set toward the middle thereof for defining a contoured surface with the cleansing heads of the bristles in the set which generally conform to the contour of the tooth surface over which the cleansing heads are moved during the cleansing of the tooth surface.

18. A toothbrush according to claim 12 wherein the bristle support is movably connected to the handle.

19. A toothbrush according to claim 18 wherein the handle is elongated and wherein the means for movably connecting the bristle support allows a predetermined angular movement of the bristle support about an axis traversing the longitudinal extent of the handle.

20. A toothbrush according to claim 19 wherein the bristle support has a length corresponding to the width of from two to three teeth and a width corresponding to about half the length of a tooth.

21. A toothbrush according to claim 12 wherein the bristles comprise base means for connecting the bristles to the bristle support.

22. A toothbrush according to claim 21 wherein the base means are movable in the bristle support.

23. A toothbrush for cleansing subgingival surfaces comprising a handle having a bristle support, a stem movably connected to the bristle support, a bristle having an elongated cleansing head, rounded end, a smooth first surface adjacent to said end to protect against injury to subgingival surfaces surrounding the tooth to be cleansed, and a second side surface, the second side surface having a textured cleansing surface defining at least one cleansing element distributed on at least a part of the length thereof, the spacing between said sides being sufficiently small to enable the cleansing head adjacent the end to penetrate the gingival sulcus of the user and therefore cleanse subgingival tooth surfaces.

24. A toothbrush according to claim 23 wherein the stem comprises means for changing the length of the stem.

25. A toothbrush according to claim 24 wherein the changing means is responsive to pressure applied to the cleansing head.

26. A toothbrush according to claim 25 wherein the cleansing element comprises means for changing the length of the cleansing element.

27. A toothbrush according to claim 26 wherein the changing means is responsive to pressure applied to the cleansing head.

28. A toothbrush bristle for cleansing subgingival surfaces comprising an elongated cleansing head having first and second, oppositely facing sides extending generally over the length of the head and terminating in an end portion of the head, the first side being adapted to face a tooth during use of the bristle and having a textured cleansing surface defining a multiplicity of tooth cleansing elements and recesses for holding a cleansing compound, the second side having substantially smooth surface, the spacing between the first and second side of the end portion being sufficiently small to enable the end portion to penetrate into a gingival sulcus of the user and thereby cleanse the subgingival tooth surface, and stem means connected with the head for attaching the bristle to a handle.

29. A toothbrush bristle for cleansing subgingival surfaces comprising an elongated cleansing head having first and second, oppositely facing sides extending generally over the length of the head and terminating in longitudinally spaced end portions of the head, the first side being adapted to face a tooth during use of the bristle, having a sufficient length so that it extends over a substantial portion of the length of the tooth and including a textured cleansing surface defining tooth cleansing elements and recesses for holding a cleansing compound, the second side having a substantially smooth surface, the spacing between the first and second sides of at least one of the end portions being sufficiently small to enable the end portion to penetrate into a gingival sulcus of the user and thereby cleanse subgingival tooth surfaces, the first and second sides of at least one end portion terminating in an edge extending from the first to the second side and having a generally rounded configuration for protecting the gingiva from injuries, and stem means for attaching the bristle to a handle.

30. A toothbrush for cleansing teeth including subgingival surfaces thereof comprising: a handle, a bristle having a narrow and elongated cleansing head having first and second, oppositely facing sides extending generally over the length of the head and terminating in longitudinally spaced end portions of the head, the first side being adapted to face a tooth during use of the bristle, having a sufficient length so that it extends over a substantial portion of the length of a tooth and including a textured cleansing surface defining a multiplicity of tooth cleansing elements and recesses for holding a cleansing compound, the second side having a substantially smooth surface, the spacing between the first and second sides of at least one of the end portions being sufficiently small to enable the end portion to penetrate into a gingival sulcus of the user and thereby cleanse subgingival tooth surfaces, edges of the head in the vicinity of the end portion connecting the first and second sides having a generally rounded configuration to protect gingival tissue surrounding the sulcus against injuries; stem means projecting generally perpendicularly from the second surface at a portion spaced from the end portions, the stem means being further attached to and extending generally perpendicularly from the handle.

* * * * *